US005111028A

United States Patent [19]

Lee

[11] Patent Number: 5,111,028

[45] Date of Patent: May 5, 1992

[54] METHOD AND CONTROL ARRANGEMENT FOR COOKING APPLIANCES

[75] Inventor: Duane A. Lee, Springfield, Tenn.

[73] Assignee: White Consolidated Industries, Inc., Cleveland, Ohio

[21] Appl. No.: 405,433

[22] Filed: Sep. 11, 1989

[51] Int. Cl.[5] ..... H05B 1/02

[52] U.S. Cl. ..... 219/506; 219/518; 219/491; 219/501; 219/413; 99/325

[58] Field of Search ..... 219/10.55 B, 10.55 F, 219/506, 492, 518, 494, 501, 412, 413, 414, 491, 10.55 R; 99/325, 487, 329

[56] References Cited

U.S. PATENT DOCUMENTS

| | | | |
|---|---|---|---|
| 4,285,391 | 8/1981 | Bourner | 219/518 |
| 4,337,384 | 6/1982 | Tanaka et al. | 219/10.55 B |
| 4,568,810 | 2/1986 | Carmean | 219/10.55 B |
| 4,831,239 | 5/1989 | Ueda | 219/518 |
| 4,833,304 | 5/1989 | Ueda | 219/10.55 B |
| 4,835,351 | 5/1989 | Smith et al. | 219/10.55 B |
| 4,933,527 | 6/1990 | Edamura | 219/10.55 B |

*Primary Examiner*—Mark H. Paschall
*Attorney, Agent, or Firm*—Pearne, Gordon, McCoy & Granger

[57] ABSTRACT

A cooking appliance is disclosed which has a cooking control system responsive to selection of a given food to be cooked, for indicating the optimum cooking position of the food in the appliance. The appliance may be an oven, with the indicator indicating the optimum position of a shelf in the oven, or the optimum position of the food on the shelf.

In a further disclosed feature, a cooking appliance may have an air circulation system, such as a blower, for circulating air about food to be cooked. A cooking control system is responsive to selection of a given food to be cooked for controlling the air flow about the food for optimum cooking thereof.

In another disclosed feature, a cooking appliance which has a control system responsive to the selection of given food and the number of rack positions required, will control the rate of energy released from the oven heat sources for optimum cooking.

18 Claims, 7 Drawing Sheets

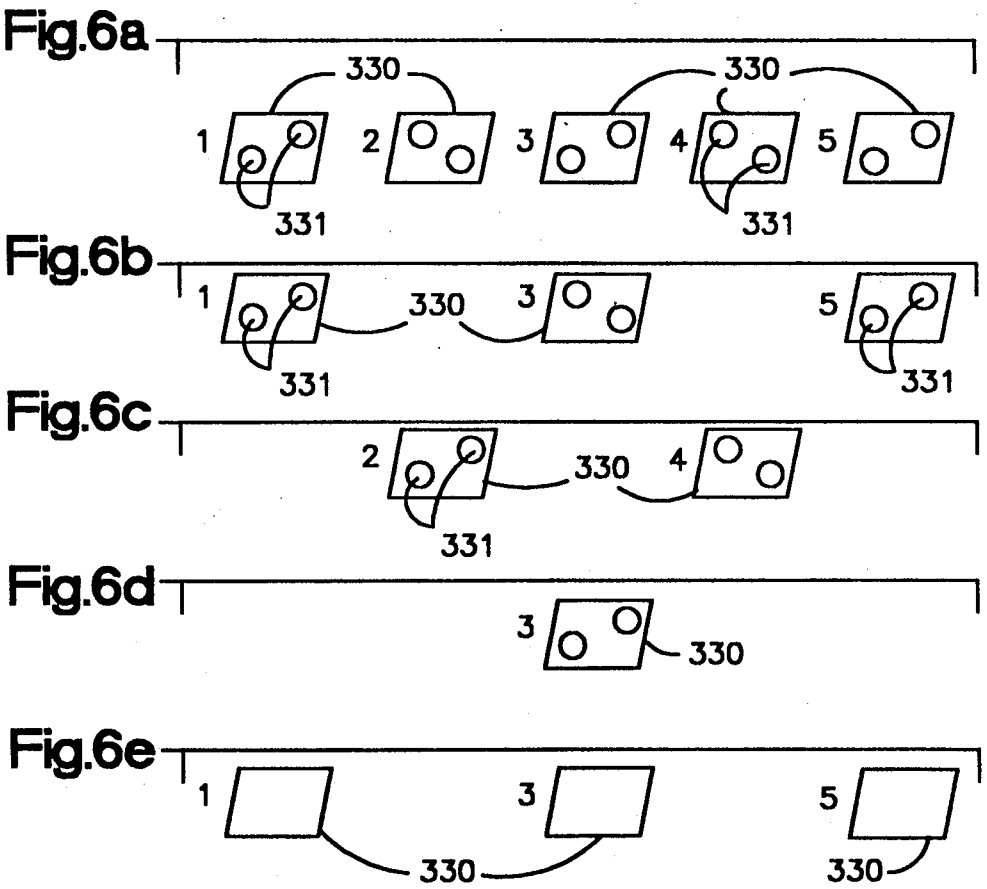
Fig.6a
Fig.6b
Fig.6c
Fig.6d
Fig.6e
330
331
1
2
3
4
5
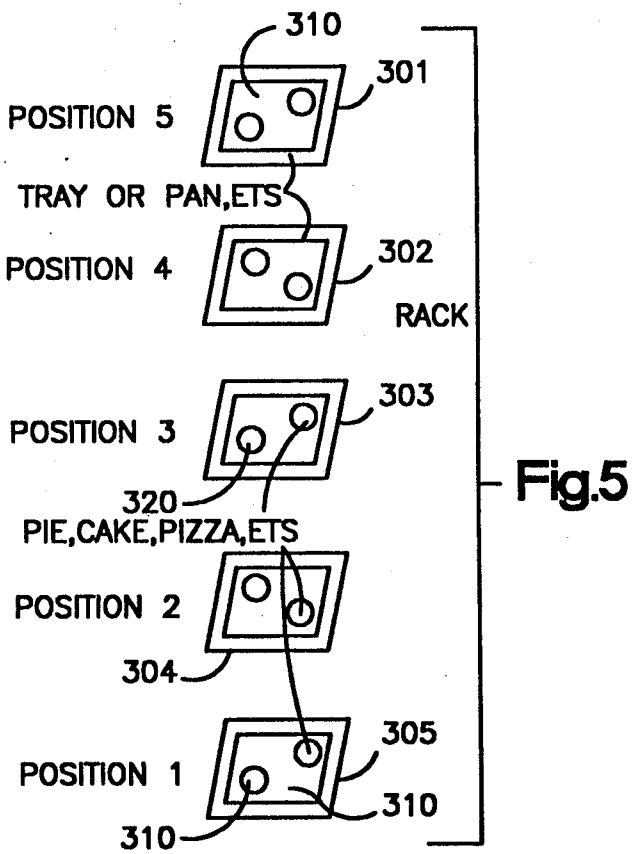
Fig.5
POSITION 5
TRAY OR PAN,ETS
POSITION 4
RACK
POSITION 3
PIE,CAKE,PIZZA,ETS
POSITION 2
POSITION 1
301
302
303
304
305
310
320

METHOD AND CONTROL ARRANGEMENT FOR COOKING APPLIANCES

BACKGROUND OF THE INVENTION

This invention relates to a control arrangement for cooking appliances, as well as to a method for controlling cooking in such appliances. While the invention is of especial use for controlling gas and electric ovens, it is apparent that it may also be advantageously employed in combination with other cooking devices.

U.S. Pat. No. 4,568,810, Carmean, discloses a microprocessor control system for a cooking appliance wherein control programs for the cooking of various predetermined foods are stored in memory, and the identification and cooking parameters of these foods are scanned in a display in order to enable an operator to readily access the optimum program for cooking the selected food. The system enables the operator to select various food parameters such as relative size of the food to be cooked and the desired doneness of the food. The control system controls various oven cooking parameters to achieve the expected results, and may introduce any required pauses in the process.

In the past, convection fans have been employed in ovens in order to provide more effective and efficient distribution of heat during cooking. Such forced circulation ovens are disclosed, for example, in U.S. Pat. Nos. 3,973,551 and 4,108,139.

SUMMARY OF THE INVENTION

The present invention is directed to an improvement in a cooking method and appliance, incorporating the advantageous control features of U.S. Pat. No. 4,568,810, in the control of air flow in a cooking cavity having forced air circulation, as well as in directing the user to establish further operating conditions to improve the cooking of food in the cavity.

It has now been found that cooking results in a forced circulation oven can be improved by controlling the air flow as a function of the food to be cooked, e.g. with the provision of variable speed fans. Such control can result in savings in cooking time, as well as permit reduction in oven temperature. Therefore, in accordance with one feature of the invention, a programmable cooking appliance is provided wherein forced air circulation in the appliance is controlled as a function of the characteristics of the food being cooked.

It has also been found that cooking results in a cooking appliance can be improved by proper placement of the food in the appliance. Therefore, in accordance with a further feature of the invention, the control system of the appliance displays optimum placement of the specific food to be cooked. For example, a display may be provided showing the user the best location of one or more shelves in the appliance cavity, as well as the optimum location of the food to be cooked on the shelves.

Briefly stated, the invention comprises a control system for a cooking appliance having an arrangement for positioning food to be cooked at a number of different positions in the appliance at which the food may be positioned. The control system comprises means for controlling the energization of the appliance for the cooking of selected foods, means for selecting foods to be cooked under the control of the control means, and indicating means. The control means comprises means responsive to selection of a given food by the selecting means for indicating on the indicating means a position for positioning the given food in the appliance for cooking the given food.

The control means may indicate, for example, the optimum position of a shelf for cooking the food, or the optimum position of food on the shelf.

The invention further provides a method for controlling a cooking appliance having an arrangement for positioning food to be cooked at a number of different positions in the appliance at which the food may be positioned, wherein the control system comprises means for controlling the energization of the appliance for the cooking of selected foods, means for selecting foods to be cooked under the control of the control means, and indicating means. In accordance with the invention, the method comprises selecting a food to be cooked in the appliance via the selecting means, and then indicating on the indicating means a position for positioning the selected food in the appliance for cooking the given food.

The cooking appliance may comprise an oven having an oven compartment and an arrangement for positioning food to be cooked at a number of vertically different positions in the compartment at which the food may be positioned.

In accordance with a further feature of the invention, a control system is provided for a cooking appliance having means for circulating air about food in the appliance. The control system comprises program means for controlling cooking parameters in the appliance for the cooking of selected foods, and means for selecting foods to be cooked under the control of the program means The circulating means is selectively operable to circulate air at a plurality of different air flow rates, and the control means further comprises means responsive to selection of a given food by the selecting means for controlling the air flow circulation rate of the circulating means.

A further method in accordance with the invention is provided for cooking food in a cooking appliance that has means for circulating air about food to be cooked in the appliance, wherein the cooking appliance includes a control system having program means for controlling cooking parameters in the appliance for the cooking of selected foods, and selecting means enabling the selecting of foods to be cooked under the control of the program means, the circulating means being selectively operable to circulate air at a plurality of different air flow rates. The method of the invention comprises selecting a food to be cooked via the selecting means, and then controlling the air flow circulation rate of the circulating means in response to selection of a given food via the selecting means.

BRIEF DESCRIPTION OF THE DRAWING

In order that the invention may be more clearly understood, it will now be disclosed in greater detail with reference to the accompanying drawing, wherein:

FIG. 5 is a simplified illustration of the placement of food on the racks of the oven;

FIGS. 6(*a*)–6(*e*) are illustrations of various display presentations of the oven;

DETAILED DISCLOSURE OF THE INVENTION

Figure 1:
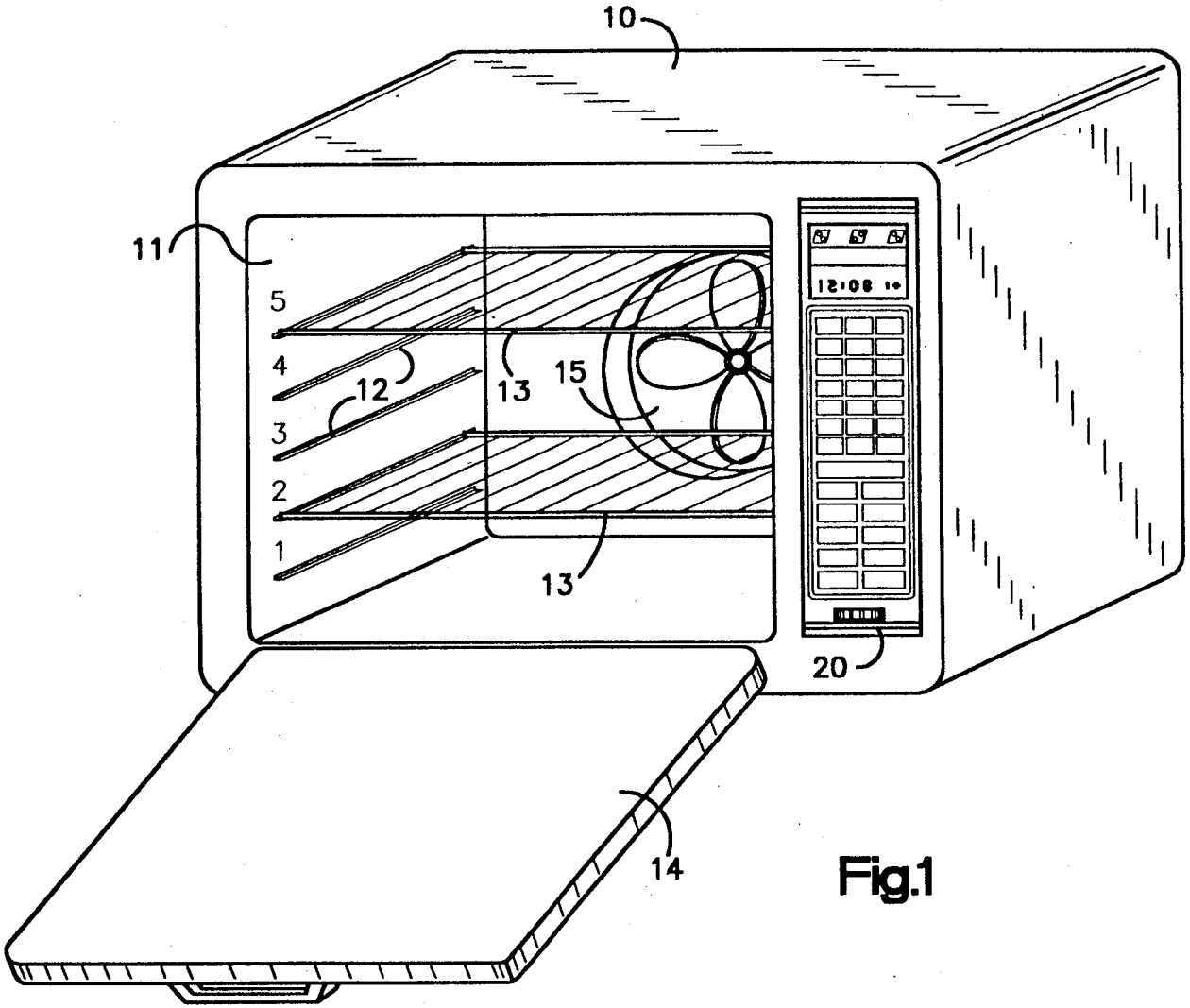
FIG. 1 is a simplified perspective illustration of an oven that may be employed in the present invention.

Referring now to the drawings, FIG. 1 illustrates an oven 10 that may incorporate the features of the invention. It will of course be apparent that the oven may employ any conventional heat source, and that the configuration of a cooking appliance as shown in FIG. 1 is not intended to limit the scope of the invention. As illustrated, the oven includes an oven cavity 11 having vertically spaced parallel shelf supports 12 on each side wall. The supports permit shelves or racks 13 to be selectively positioned at various levels in the cavity. The cavity is provided with an access door 14 in the conventional manner, and a convection fan or blower 15 is mounted in the rear wall of the cavity in order to permit circulation of air within the cavity. The mounting and ducting of the blower may be in accordance with known techniques.

Figure 2:
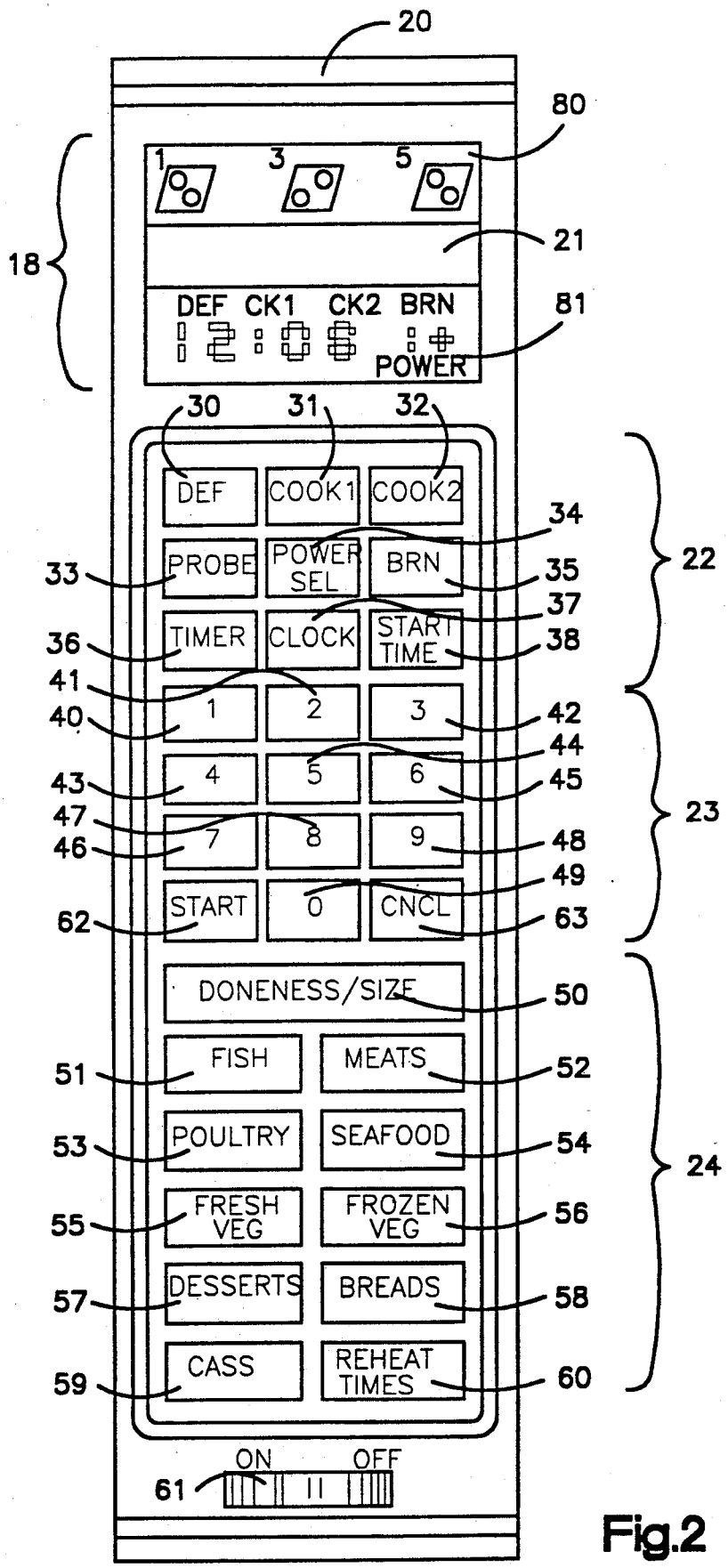
FIG. 2 is a front view of the control panel of the oven of FIG. 1.

The oven also is provided with a display and control panel 20 which will be described in detail with reference to FIG. 2.

The display and control panel 20 may be of the type generally disclosed in U.S. Pat. No. 4,568,810, with modifications as discussed. Thus the control panel has an alphanumeric display 21, pictorial display 80, numeric display 81, central sections 22, 23 with a plurality of function control keypads 30–38 and a plurality of numeric keypads 40–49, respectively, and a lower section 24 with a plurality of selection keypads 50–60. An On-Off switch 61 is provided at the bottom of the panel. The control panel is also provided with a START keypad 62 and a CANCEL operation keypad 63.

The display section 18 may have an upper portion 80 for the display of pictorial information, such as food placement and rack position to use, middle portion 21 for the display of messages, such as menu messages and prompts, and a lower portion 81 for displaying various numeric information, such as time of day, cooking times, power levels, etc.

Figure 3:
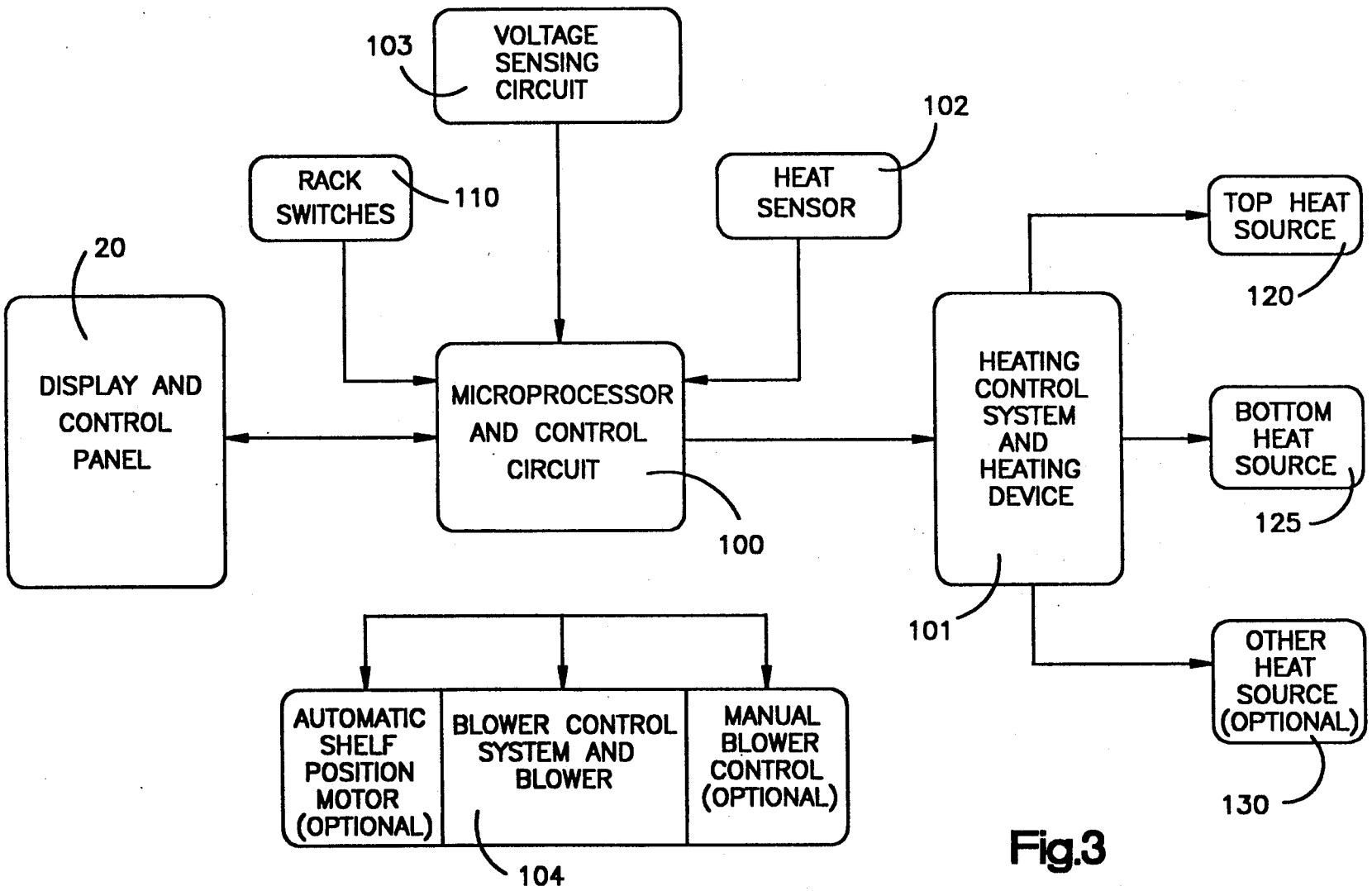
FIG. 3 is a block diagram of the oven.

FIG. 3 illustrates a control system that may be employed in the cooking appliance, in accordance with the invention. This system includes a microprocessor and control circuit 100 that incorporates the program memory for the system. This circuit is connected to the display and control panel 20 for receiving input control signals from the various keypads, and for energizing the display devices in accordance with the program. The control circuit 100 is also connected to the heating control system and heating device 101, to control the energization of the cooking appliance. Thus, for example, this arrangement may comprise a fuel gas system, and electrical oven control system, or a microwave energy control system. The control of the device 101 may be responsive to an input from a heat sensor 102 positioned, for example, in an oven heated by the device 101, as well as to an input from a voltage sensing circuit 103, so that any desired heating level may be maintained in the oven.

The control circuit 100 is also connected to a blower control system and blower 104 for controlling the energization of the circulating blower 15 positioned to circulate air in the oven cavity.

As further illustrated in FIG. 3, the control system and heating device 101 may include, or be connected to energize, a top heat source 120 located adjacent the upper portion of the oven chamber, a bottom heat source 125 located adjacent the lower portion of the oven chamber, and, optionally, a further heat source 130 located, for example, in the vicinity of the convection blower 15. As will be discussed, the ratio of energization of these heat sources may be controlled by the microprocessor and control circuit 100, as a function of the selected food, quantity, etc., to obtain optimum cooking of the food.

Figure 4:
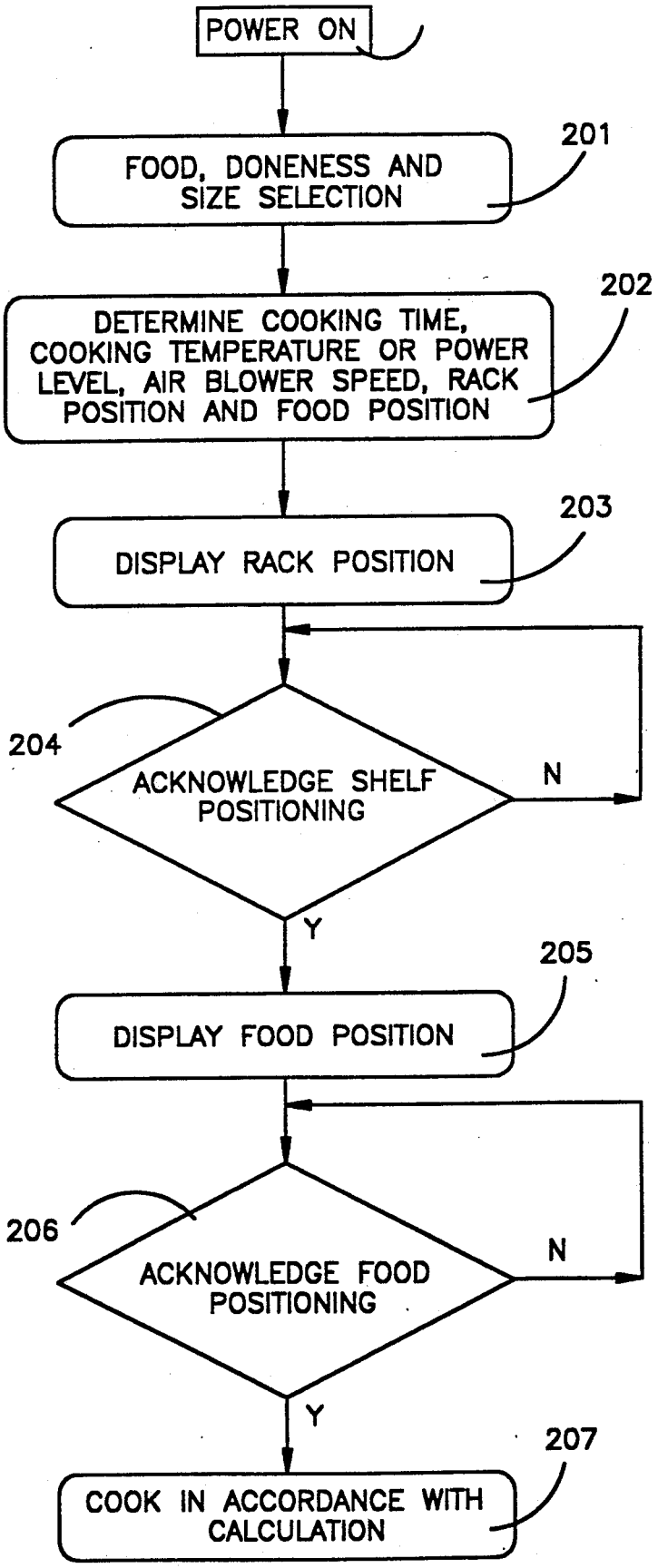
FIG. 4 is a flow diagram of a cooking appliance in accordance with the invention.
Figure 7A:
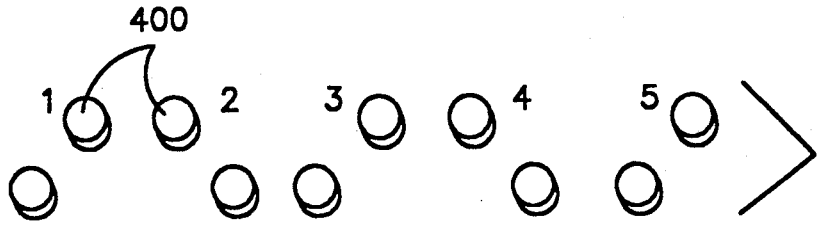
FIGS. 7(*a*)–7(*d*) illustrate further presentations that may be displayed.
Figure 7B:
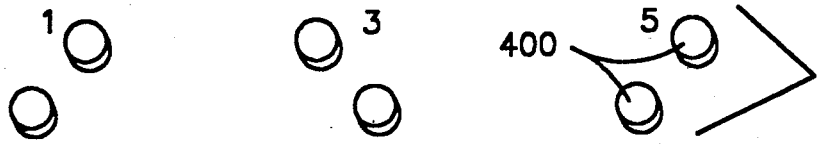
Figure 7C:
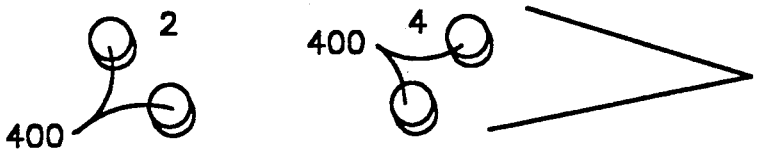
Figure 7D:
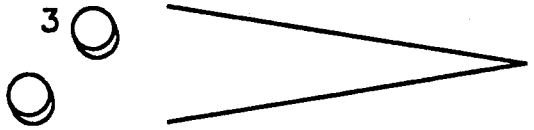
Figure 8A:
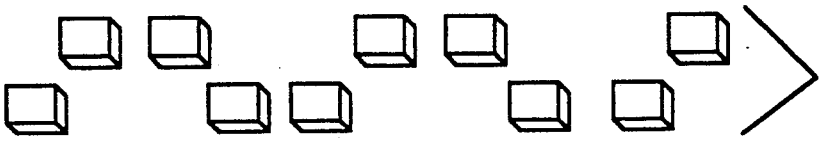
FIGS. 8(*a*)–8(*d*) illustrate still further display presentations.
Figure 8B:
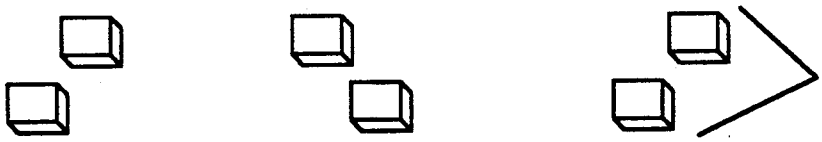
Figure 8C:
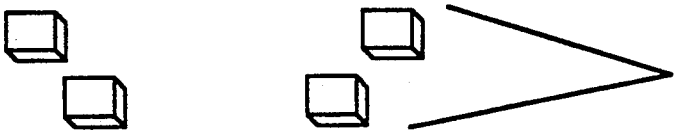
Figure 8D:
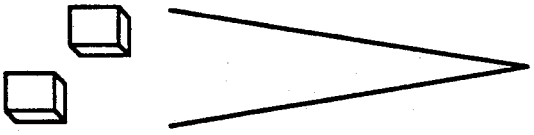

FIG. 4 is a flow diagram of the operation of the cooking appliance of the invention. After the appliance is turned on, at block 200, prompts are given, and responses are made thereto, for selecting the food to be cooked, the doneness of the food to be cooked, and the size of the food to be cooked. This process may be effected in a manner similar to that described in the above discussed U.S. Pat. No. 4,568,810, the disclosure of which is incorporated herein by reference. Briefly, however, after turning the appliance on, the user presses one of the keypads 51–60 identifying a generic food group. In response thereto, the names of various foods of the chosen group are scanned in the alphanumeric display portion 21. When the desired food is displayed, the user may indicate this choice by ceasing to depress the food group keypad. The appliance may then display a prompt for the operator to indicate the size, quantity, or other characteristic of the food necessary to determine the cooking parameters. For example, for the cooking of potatoes, prompts may be given to use a keypad to input the number of potatoes, and a scanning display may prompt the user to provide a suitable input regarding the size of the potatoes. Then, the appliance may display a prompt for the user to input an indication of the doneness desired for the food, e.g. well-done, medium, less than medium, etc.

After the above selections have been made, referring again to FIG. 4, the program of the appliance calculates the necessary parameters, as indicated in block 202, for cooking the food as directed. This may include use of an algorithm such as disclosed in U.S. Pat. No. 4,568,810. It also includes determination of the optimum position of the food in the appliance, and the optimum speed of the air blower. These latter parameters may be determined empirically, and stored in the memory of the microprocessor and control circuit 100.

In accordance with a further feature of the invention adapted for use with ovens that have more than one heating source, such as the top, bottom and optional additional sources 120, 125 and 130 illustrated in FIG. 3, it has been found that optimum cooking characteristics may be obtained by controlling the ratio of energization of the various heaters as a function of the food selected, as well as the rack positions and food placement positions that have been determined to enable for the best cooking combination. Accordingly, step 202 (FIG. 4), or a further step in the program, may determine the best ratio of energization of the heat sources for that particular food combination, and, in step 207, provide such energization. For example, a single tray of food on the center rack may require a high level of both top and bottom heat, while three trays may require a lower level of heat from these sources if the trays are to be placed closer to the heat sources. The invention thereby enables the automatic energization of the heat sources at a large number of different levels, rather than the manual setting of one or two levels used on some ovens today. The automatic setting in accordance with the invention may be based upon food type, quantity and/or placement.

As an example of the positioning of food to be cooked in an oven cavity, FIG. 5 represents the internal positions in an oven cavity having five shelves 301–305 and/or shelf positions, from top to bottom. For the cooking of some foods, a pan 310 may be provided on the various shelves that are to be used. If it is desired to cook generally round specific food items 320, it may have been empirically determined that the optimum cooking conditions are achieved if the food items are arranged on the shelves as illustrated in FIG. 5. Accordingly, when this specific number and type of food are selected in the selection process, the program addresses its memory to find that the arrangement of FIG. 5 is the optimum arrangement.

Referring again to FIG. 4, the appliance may then display a prompt or scanned in the pictorial display 80, at block 203, that indicates the rack position that the program has determined to be optimum for the selected food. After the user has changed the positions of the shelves as prompted, an indication of this may be given to the appliance, for example by pressing a given keypad, or by other suitable means, as indicated at block 204. In an especially suitable embodiment of the invention, separate switches 110 (FIG. 3) may be provided to sense the positioning of a shelf at each of the shelf positions, in order to automatically signal to the microprocessor and control circuit that the shelves have been placed at the optimum positions, either to permit the program to proceed to the next step or to verify that the user's indication of proper positioning was correct. The appliance then may provide a prompt in the pictorial display 80 that indicates the optimum position of the food on the respective shelves, as indicated at block 205. Again, this position is based upon empirical information that is stored in the microprocessor and control circuit 100. When the user acknowledges that the food has been placed in the prompted positions, at block 206, the appliance may then proceed to cook the food in the calculated manner, as indicated at block 207.

The configuration of the display for indicating the optimum shelf positions and food positions on the shelves depends, of course, upon the sophistication of the display. In some cases it may be desirable to combine the shelf position and food position to provide a single prompting display for each of these conditions, i.e. combining steps 203 and 205 of FIG. 4. Thus, FIGS. 6(*a*)–6(*d*) illustrate simple single line displays for combining the prompts for these two position parameters. FIG. 6(*a*) illustrates a suitable prompt for the food positions indicated in FIG. 5, wherein the required shelf or rack positions are indicated by numbered rhombuses 330, and the positions of the food on the shelves or racks are indicated by suitable geometric FIGS. 331. FIG. 6(*b*) illustrates a display of this type wherein only the first, third and fifth shelves are to be employed, FIG. 6(*c*) illustrates a similar display wherein only the second and fourth shelves are to be employed, and FIG. 6(*d*) illustrates a similar display wherein only the third shelf is to be employed. It is of course apparent that this type of display may also indicate only the shelf positions, as illustrated in FIG. 6(*e*), without the placement of food thereon. This arrangement may constitute a display in accordance with step 203 of FIG. 4, or it may constitute a simplified display for the case where only one item is to be provided on each shelf.

Figure 9A:
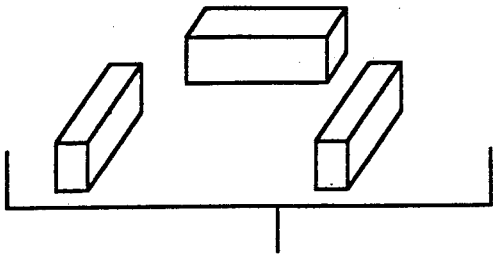
FIGS. 9(*a*)–9(*c*) illustrate additional display presentations.
Figure 9B:
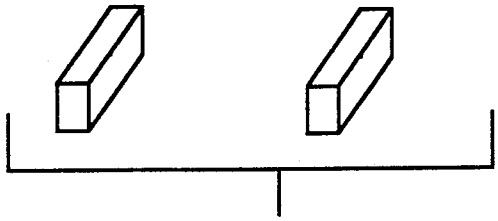
Figure 9C:
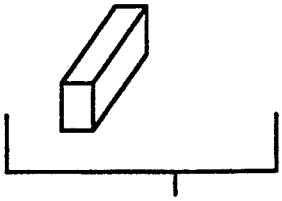

The display presentations of FIGS. 7(*a*)–7(*d*) correspond to those of FIGS. 6(*a*)–6(*d*), with the exception that no tray is displayed, and the food items are shaped to more closely represent round food items or containers, such as round cake type pans, small pizzas, or pies. Thus, the display may be controlled in response to the selection of the food to be cooked, to simulate insofar as possible the shape of the food or container for that food. Accordingly, FIGS. 8(*a*)–8(*d*), which also correspond to FIGS. 6(*a*)–6(*d*), show square containers or food, for display for example for the positioning of rectangular pans, casserole dishes, muffin pans or the like. In a like manner, FIGS. 9(*a*)–9(*c*) depict a display that may be used when the selected food is bread, these figures showing the placement of three, two and one loaf, respectively, on a shelf of the oven. It is of course apparent that other configurations may be employed for the displayed items, in order to further assist the user in the operation of the appliance.

In accordance with a still further feature of the invention, the number of racks to be used may be determined by the user. In this embodiment, at the step of the program at which rack selection is to be made, the microprocessor and control circuit may control the display to sequentially depict one, two, three, four and five racks, with a pause between each display to permit the user to depress a predetermined keypad to select the then displayed number of racks. In this embodiment, the program may then display the proper distribution of food on the number of shelves that have been selected.

It is of course apparent that the invention is not restricted to the above form of the display that is presented to the user.

It is of course not necessary to provide a display or prompt for the speed of the blower, if this is to be effected automatically. It is within the scope of the invention, however, that a suitable prompt be made for blower speed, with the appliance being provided with a manual control over this parameter. In this case, the prompt for blower speed may constitute a simple alphanumeric message to set the blower to a given level.

It is also within the contemplation of the invention that, after determination of the optimum shelf position, the control system may automatically position the shelves to be at such positions. For this purpose, such a control arrangement may be provided, as illustrated in FIG. 3.

While the invention has been disclosed and described with reference to a single embodiment, it will be apparent that variations and modifications may be made therein, and it is therefore intended in the following claims to cover each such variation and modification as falls within the true spirit and scope of the invention.

What is claimed is:

1. In a control system for a cooking appliance having an arrangement for positioning food to be cooked at a number of different positions within the appliance, said control system comprising means for controlling the energization of the appliance for the cooking of selected foods, means for selecting foods to be cooked under the control of said control means, and indicating means, the improvement wherein said control means responds to the selection of a given food by said selecting means by indicating on said indicating means a position for said given food within said appliance for cooking said given food.

2. The control system of claim 1 wherein said appliance includes a shelf for receiving food to be cooked, said shelf being positionable at a plurality of different positions, and said control means comprising means for controlling said indicating means to indicate a position of said shelf.

3. The control system of claim 1 wherein said appliance has a shelf for receiving food to be cooked, and said control means comprises means for controlling said indicating means to indicate a position on said shelf for placement of food to be cooked.

4. The control system of claim 1 wherein said appliance has a shelf for receiving food to be cooked, and said control means comprises means for controlling said indicating means to provide a combined indication of a position of said shelf and a position of said food on said shelf.

5. A method for controlling a cooking appliance having an arrangement for positioning food to be cooked at a number of different positions in the appliance, said control system comprising means for controlling the energization of the appliance for the cooking of selected foods, means for selecting foods to be cooked under the control of said control means, and indicating means, the improvement wherein said method comprises the steps of selecting a food to be cooked in said appliance via said selecting means and indicating on said indicating means a position for said selected food within said appliance for cooking said given food.

6. The method of claim 5 in which said appliance includes a shelf for receiving food to be cooked, and said shelf being positionable at a plurality of different positions, wherein said step of indicating further comprises indicating on said indicating means a position of said shelf.

7. The method of claim 5 in which said appliance includes a shelf for receiving food to be cooked, said shelf being positionable at a plurality of different positions, wherein said step of indicating further comprises sequentially indicating different numbers of rack positions for selection by a user.

8. The method of claim 5 in which said appliance includes a shelf for receiving food to be cooked, wherein said step of indicating further comprises indicating on said indicating means a location on said shelf for placing food to be cooked.

9. In a control system for an oven having an oven compartment and an arrangement for positioning food to be cooked at a number of vertically different positions within said compartment, said control system comprising means for controlling the energization of the oven for the cooking of selected foods, means for selecting foods to be cooked under the control of said control means, and indicating means, the improvement wherein said control means responds to the selection of a given food by said selecting means by indicating on said indicating means a vertical position for positioning said given food within said compartment for cooking said given food.

10. The control system of claim 9 wherein said arrangement for positioning food comprises means for locating food at different horizontal positions within said compartment, and said means responsive to selection of a given food further comprising means for indicating on said indicating means a horizontal position for positioning said given food within said compartment for cooking said given food.

11. The control system of claim 9 wherein said oven further comprises a circulating fan.

12. In a control system for a cooking appliance having means for circulating air about food within said appliance, the improvement wherein said control system comprises program means for controlling cooking parameters in the appliance for the cooking of selected foods, and means for selecting foods to be cooked under the control of said program means, said circulating means being selectively operable to circulate air at a plurality of different air flow rates, said control means further comprising means responsive to selection of a given food by said selecting means for controlling the air flow circulation rate of said circulating means.

13. A method for cooking food in a cooking appliance having means for circulating air about food to be cooked in said appliance, the cooking appliance including a control system comprising program means for controlling cooking parameters in the appliance for the cooking of selected foods, and selecting means enabling the selecting of foods to be cooked under the control of said program means, said circulating means being selectively operable to circulate air at a plurality of different air flow rates, the improvement wherein said method comprises the steps of selecting a food to be cooked via said selecting means, and controlling the air flow circulation rate of said circulating means in response to selection of a given food via said selecting means.

14. In a control system for an oven having an oven compartment, an arrangement for positioning food to be cooked in said compartment, and a blower for circulating air in said compartment, the improvement wherein said control system comprises program means for controlling the cooking process in the oven for the cooking of selected foods, and means for selecting foods to be cooked under the control of said program means, said blower being selectively operable at a plurality of different operating speeds, said control means further comprising means responsive to selection of a given food by said selecting means for controlling the speed of operation of said blower.

15. In a control system for an oven having an oven compartment, an arrangement for positioning food to be cooked in said compartment, and a blower for circulating air in said compartment, the improvement wherein said control system comprises program means for controlling the cooking process in the oven for the cooking of selected foods, a display, and means for selecting foods to be cooked under the control of said program means, said system further comprising means for controlling said blower to be selectively operable at a plurality of different operating speeds, said control means further comprising means responsive to selection of a given food by said selecting means for displaying a prompt for indicating a speed of operation of said blower.

16. In a control system for an oven having an oven compartment, and an arrangement for positioning food to be cooked within said compartment, the improvement wherein said control system comprises program means for controlling the cooking process in the oven for the cooking of selected foods, a display, and means for selecting foods to be cooked under the control of said program means, and further comprises means for controlling said food positioning means, whereby said food is positioned within said compartment in a position determined by said control system.

17. In a control system for a cooking appliance having a plurality of cooking heat sources, and means for energizing said cooking heat sources, the improvement wherein said control system comprises program means for controlling cooking parameters in the appliance for the cooking of selected foods, and means for selecting foods to be cooked under the control of said program means, said energizing means for said heat sources being operable to selectively energize said heat sources at a plurality of different heat levels, said control means further comprising means for controlling the ratio of energization of said heat sources as a function of the food selected by said selecting means.

18. In a control system for an oven having an oven compartment with a plurality of racks, and means for selectively holding said racks at a number of different positions within said compartment, said control system comprising control means for controlling the energization of the oven for the cooking of selected foods, means for selecting foods to be cooked under the control of said control means, the improvement further comprising a switch coupled to said control system and positioned to detect the positioning of said racks at each of said positions, said control means comprising means responding to the selection of a given food by said selecting means and the sensing of the position of a rack by said switch means by controlling said energization of the oven.

* * * * *